US012004650B2

(12) United States Patent
Brooks

(10) Patent No.: US 12,004,650 B2
(45) Date of Patent: Jun. 11, 2024

(54) FACILITATED ENTRY AND EXIT SEATING SYSTEM AND METHOD OF USE

(71) Applicant: Scott W. Brooks, Wheeler, TX (US)

(72) Inventor: Scott W. Brooks, Wheeler, TX (US)

( * ) Notice: Subject to any disclaimer, the term of this patent is extended or adjusted under 35 U.S.C. 154(b) by 0 days.

(21) Appl. No.: 16/166,349

(22) Filed: Oct. 22, 2018

(65) Prior Publication Data

US 2020/0121082 A1 Apr. 23, 2020

(51) Int. Cl.

| | |
|---|---|
| ***A47C 1/04*** | (2006.01) |
| ***A47C 1/06*** | (2006.01) |
| ***A47C 1/11*** | (2006.01) |
| ***A47C 3/18*** | (2006.01) |
| ***A47C 3/20*** | (2006.01) |
| ***A47C 7/50*** | (2006.01) |
| *A47C 3/14* | (2006.01) |

(52) U.S. Cl.

CPC ..... *A47C 1/06* (2013.01); *A47C 1/11* (2013.01); *A47C 3/18* (2013.01); *A47C 3/20* (2013.01); *A47C 3/14* (2013.01); *A47C 7/5066* (2018.08)

(58) Field of Classification Search

CPC .... A47C 1/06; A47C 1/11; A47C 3/14; A47C 3/18; A47C 3/20; A47C 7/5066

USPC ... 297/344.21–344.23, 423.1, 423.19–423.3, 297/461

See application file for complete search history.

(56) References Cited

U.S. PATENT DOCUMENTS

| | | | | | |
|---|---|---|---|---|---|
| 2,678,086 | A * | 5/1954 | Mohr | A47C 1/06 | 297/240 |
| 4,372,605 | A * | 2/1983 | Cervantes | A47C 1/04 | 297/188.11 |
| 4,753,407 | A * | 6/1988 | Brock | A47C 1/11 | 297/423.1 X |
| 4,896,916 | A * | 1/1990 | Marter | A47C 1/04 | 297/423.1 X |
| 5,039,167 | A * | 8/1991 | Sweet | A47C 1/04 | 297/423.28 |
| 5,098,160 | A * | 3/1992 | Moore | A47C 16/025 | 297/423.1 X |
| 6,761,339 | B2 * | 7/2004 | Minami | A47C 1/06 | 297/344.19 X |
| 8,931,848 | B2 * | 1/2015 | Archambault | B60N 2/90 | 297/423.26 |
| 9,642,465 | B1 * | 5/2017 | Park | A47C 7/52 | |
| 10,405,661 | B2 * | 9/2019 | Adler | G01L 5/00 | |
| 2005/0189808 | A1 * | 9/2005 | Lin | A47C 7/506 | 297/423.21 |
| 2011/0133527 | A1 * | 6/2011 | Taylor | A47C 7/506 | 297/423.37 X |
| 2019/0231077 | A1 * | 8/2019 | Park | A47C 7/506 | |

* cited by examiner

*Primary Examiner* — Rodney B White

(74) *Attorney, Agent, or Firm* — Richard Eldredge; Eldredge Law Firm

(57) ABSTRACT

A facilitated entry and exit seating system allows a person to rest in a hair salon style chair without the obstruction of a footrest. The seat portion rotates so that the footrest is at the side of the seat. The person enters and the seat is rotated to allow for use of the footrest.

2 Claims, 6 Drawing Sheets

FACILITATED ENTRY AND EXIT SEATING SYSTEM AND METHOD OF USE

BACKGROUND

1. Field of the Invention

The present invention relates generally to seating systems, and more specifically, to a seating system for enabling or facilitating work on a client's hair.

2. Description of Related Art

Seating systems are well known in the art and are effective means to allow a person to rest while in a seated position. For example, FIG. 1 depicts a conventional hair salon chair system 101 having a seat 103 attached to a post 105 having a footrest 107. During use, a person will rest on the seat 103 and place their feet on the footrest 107 while their hair is styled, cut or otherwise worked on.

One of the problems commonly associated with system 101 is limited efficiency. For example, when the person gets in or out of the chair 101 they have to move around the footrest 107 and become tangled therein causing injury, embarrassment or damage.

Accordingly, although great strides have been made in the area of hair salon chair systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
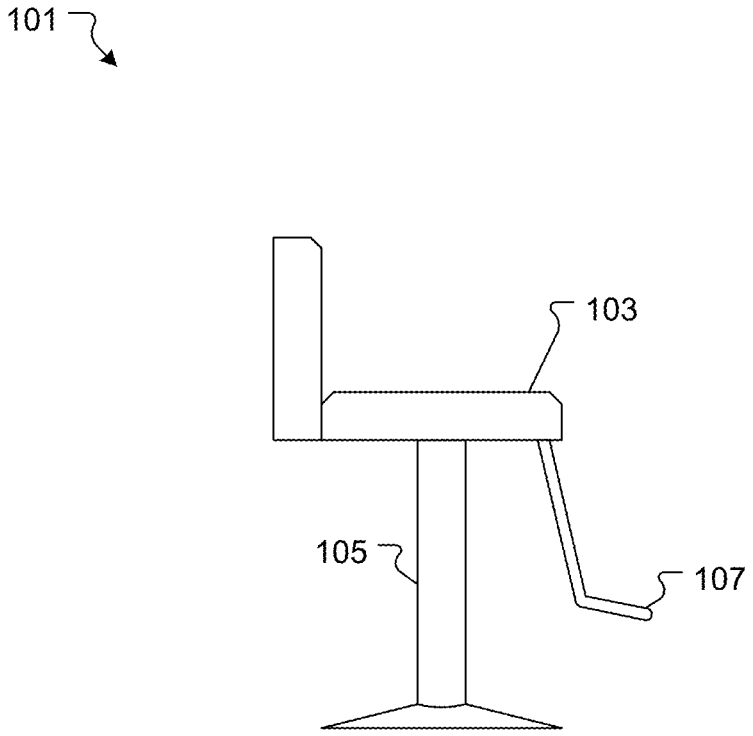
FIG. 1 Prior Art
FIG. 1 is a side view of a common hair salon chair system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional hair salon chair systems. Specifically, the invention of the present application enables a person to enter or exit a hair salon style chair without obstruction from the footrest. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
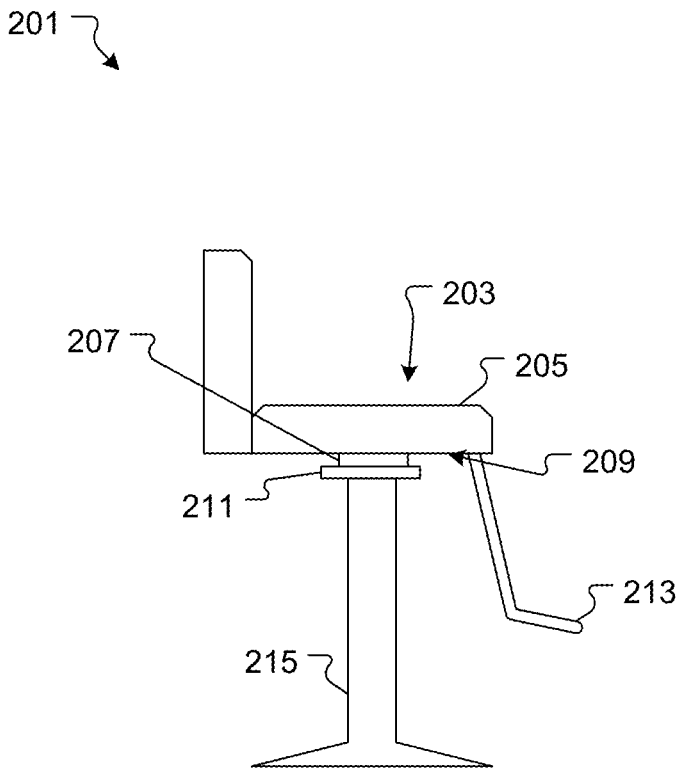
FIG. 2 is a side view of a facilitated entry and exit seating system in accordance with a preferred embodiment of the present application.

Referring now to the drawings wherein like reference characters identify corresponding or similar elements throughout the several views, FIG. 2 depicts a side view of a facilitated entry and exit seating system in accordance with a preferred embodiment of the present application. It will be appreciated that system 201 overcomes one or more of the above-listed problems commonly associated with conventional hair salon chair systems.

In the contemplated embodiment, system 201 includes a seat 203 that includes a body 205 attached to a swivel 207 on the bottom surface 209 thereof. The swivel 207 also be attached to a base plate 211 and the base plate 211 attached to a post 215. The swivel 207 remains stationary with respect to the body 205 and again stationary with respect to the base plate 211 but that the body 205 and base plate 211 pivot with respect to each other via the swivel 207. The base plate 211 having a footrest 213 attached thereto.

Figure 3A:
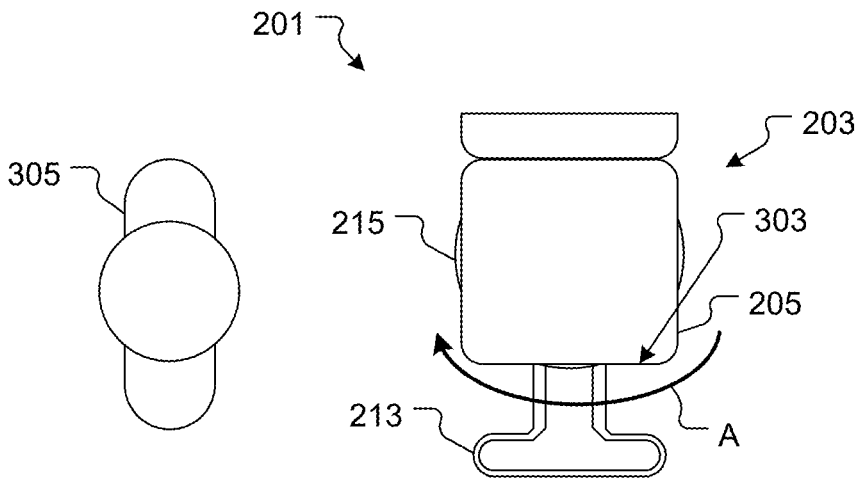
FIGS. 3A, 3B and 3C are top view of the system of FIG. 2 in use.
Figure 3B:
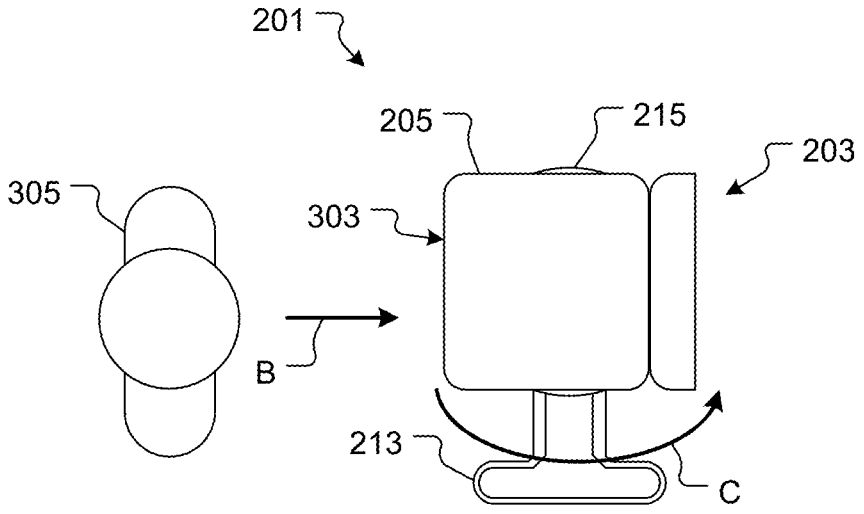
Figure 3C:
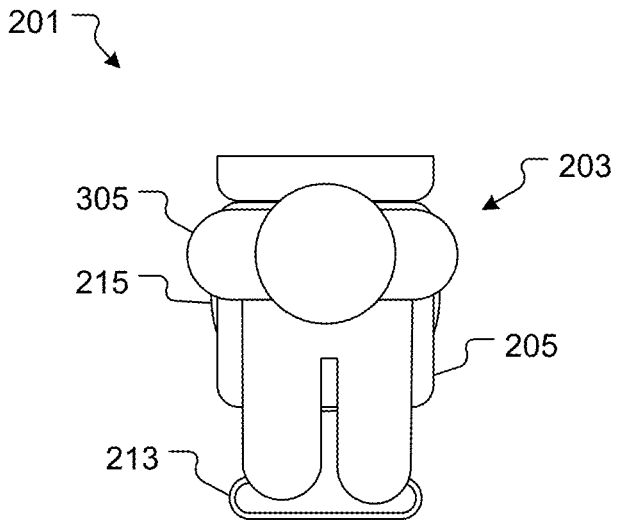

Referring now to FIGS. 3A, 3B and 3C, in use, the seat 203 is rotated as depicted by motion A, via the swivel 207 so that the footrest 213 is preferably ninety degrees away from the front surface 303 of the seat 203 so that a person 305 enters as depicted by motion B and rests on the seat 203. The seat is then rotated as depicted by motion C, via the swivel 207 so that the footrest 213 is in line with the front surface 303 of the seat and the person rests their feet on the footrest 213.

It should be appreciated that one of the unique features believed characteristic of the present application is that the swivel allows a person to enter the seat without navigating around the footrest.

Figure 4:
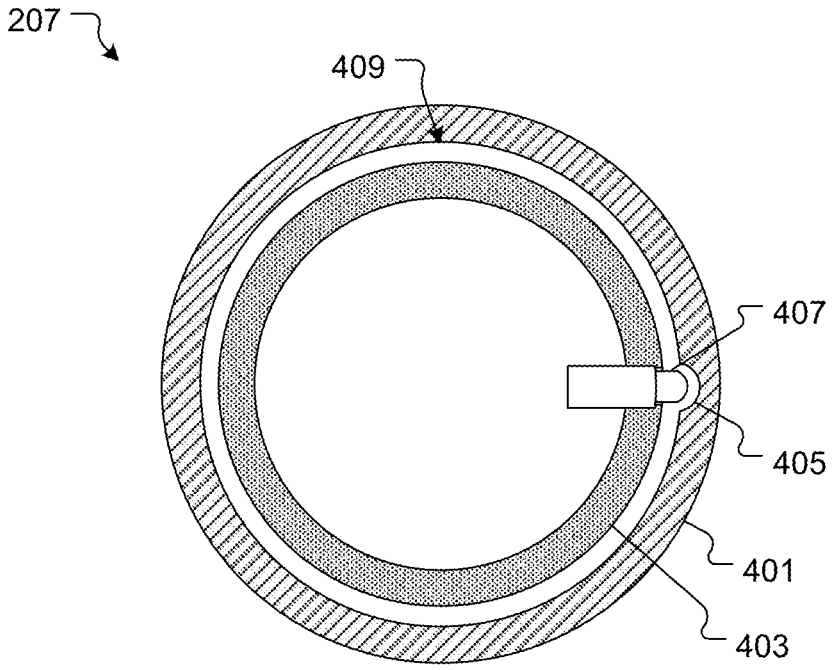
FIG. 4 is a cross-sectional top view of the swivel of FIG. 2.

Referring now to FIG. 4 a preferred embodiment of the swivel 207 is depicted. The swivel 207 having an outer ring 401 and an inner ring 403 in rotational communication. The outer ring 401 having a receptacle 405 extending inward from the inner surface 409 thereof and configured to accept a catch 407 that is attached to and protrudes from the inner ring 403. When pressure is exerted to rotate the inner ring 403 with respect to the outer ring 401 the catch 407 releases and allows the inner ring 403 to rotate.

Another unique feature believed characteristic of the present application is that the receptacle 405 and catch 407 enable the seat 203 to remain stationary with respect to the footrest 213 except for when a person is entering or exiting the seat 203.

Figure 5:
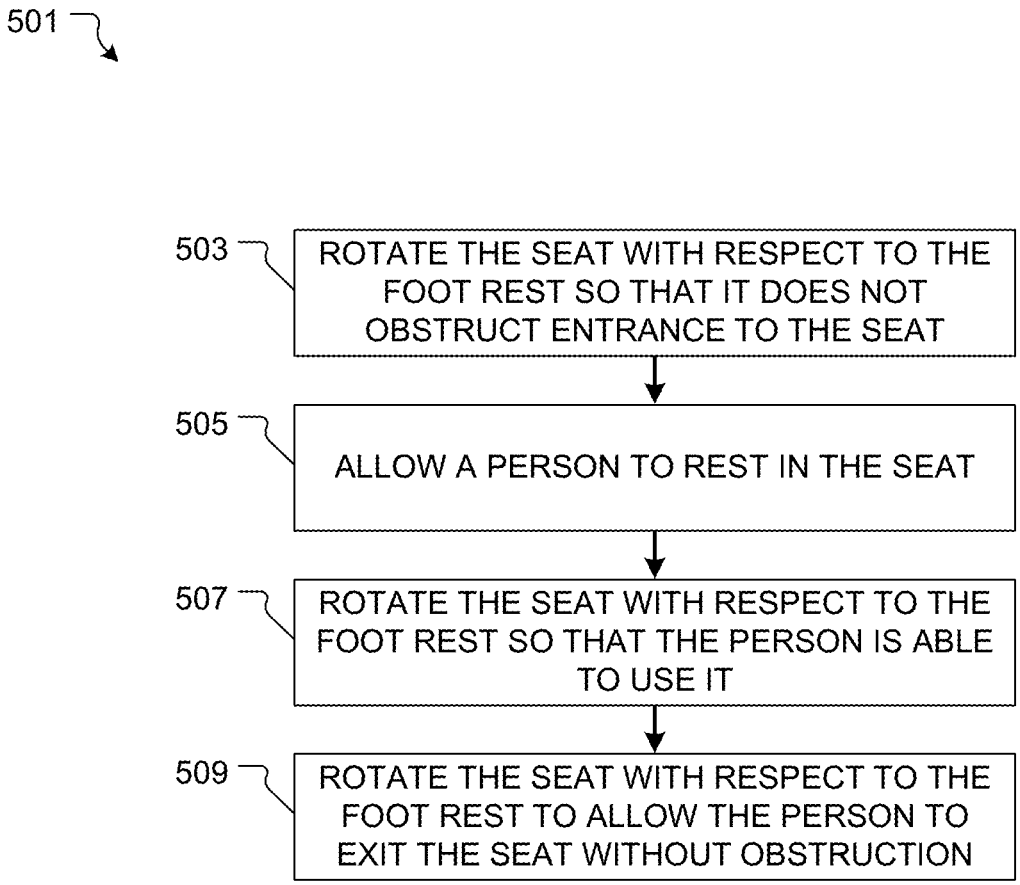
FIG. 5 is a flowchart of the preferred method of use of the system of FIG. 2.

Referring now to FIG. 5 the preferred method of use of the system 201 is depicted. Method 501 includes rotating the seat with respect to the footrest so that the footrest does not obstruct entrance or exit of the seat 503, allowing a person to rest in the seat 505, rotating the seat with respect to the footrest so that the person is able to rest their feet on the footrest 507 and rotating the seat with respect to the footrest to allow a person to exit the seat without obstruction 509.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A facilitated entry and exit seating system comprising:

an elongated outer shaft that extends from a first end to a second end;

an elongated inner shaft that extends from a third end to a fourth end;

a seat attached to the first end, the seat having a front;

a base plate attached to the fourth end;

wherein the second end slides within the third end;

a swivel configured to restrict rotational movement of the second end relative to the third end, the swivel having a spring-loaded catch secured to the third end and configured to engage with a receptacle partially disposed within a thickness of the second end;

the base plate having at least one footrest fixedly attached thereto;

wherein the front of the seat is accessible when entered or exited.

2. A method of facilitating the entrance or exit from a seat given the system of claim 1, comprising:

rotating the seat with respect to the footrest so that the footrest does not obstruct entrance or exit of the seat;

allowing a person to rest in the seat;

rotating the seat with respect to the footrest so that the person is able to rest their feet on the footrest; and rotating the seat with respect to the footrest to allow a person to exit the seat without obstruction.

* * * * *